United States Patent [19]

Ichiyanagi et al.

[11] 4,407,652

[45] Oct. 4, 1983

[54] APPARATUS FOR CALCINING RAW MATERIALS IN THE FORM OF POWDER OR PARTICLES

[75] Inventors: Toshikazu Ichiyanagi; Kanzaburo Sudoh, both of Kumagaya; Keisuke Ogawa, Yotsukaido; Nobuhiro Yamazaki, Tokyo, all of Japan

[73] Assignees: Ishikawajima-Harima Jukogyo Kabushiki Kaisha; Chichibu Cement Kabushiki Kaisha, both of Tokyo, Japan

[21] Appl. No.: 326,049

[22] Filed: Nov. 30, 1981

[30] Foreign Application Priority Data

Dec. 15, 1980 [JP] Japan ..... 55/175794

[51] Int. Cl.[3] ..... F27B 15/00

[52] U.S. Cl. ..... 432/58; 432/106

[58] Field of Search ..... 432/58, 106; 106/100

[56] References Cited

U.S. PATENT DOCUMENTS

| | | | |
|---|---|---|---|
| 3,452,968 | 7/1969 | Shimizu et al. | 34/10 |
| 3,755,914 | 9/1973 | Mark | 432/58 |
| 3,869,248 | 3/1975 | Hirai et al. | 432/106 |
| 4,025,295 | 5/1977 | Touborg | 432/106 |
| 4,329,141 | 5/1982 | Habermehl et al. | 432/58 |
| 4,337,032 | 6/1982 | Duplouy et al. | 432/106 |

*Primary Examiner*—John J. Camby

*Attorney, Agent, or Firm*—Scrivener, Clarke, Scrivener and Johnson

[57] ABSTRACT

Disclosed is an apparatus for calcining raw materials in the form of powder or particles. The gases entrain the particles to spiral upward in the calcining furnace. In an upper throttle chamber the relatively coarse particles which have not been completely calcined are separated from the gas flow and returned into the calcining zone to be calcined again. This pattern of material flow is repeated several times. The calcining efficiency can be improved, so that the furnace can be made small in size. The uniformly calcined particles are discharged from the top of the furnace and introduced into one or more cyclone separators through an outlet duct including a 180° bend section.

5 Claims, 5 Drawing Figures

APPARATUS FOR CALCINING RAW MATERIALS IN THE FORM OF POWDER OR PARTICLES

FIELD OF THE INVENTION

The present invention relates to an apparatus for calcining raw materials in the form of powder or particles for production of, for instance, cement or alumina.

BACKGROUND OF THE INVENTION

In general, cement has been produced in plants provided with a suspension preheater system or systems having a calcining furnace. The calcining furnace comprises a cylinder and an inverted frustoconical section extending downwardly from the former. The top of the cylinder is connected through an outlet duct with a cyclone separator or separators. Particles to be calcined are charged into a kiln exhaust gas duct and carried by kiln exhaust gases upward into the inverted frustoconical section where they are mixed with combustion air introduced through an air duct. The particles are calcined as they spiral upward in the furnace.

The calcining furnace of the type described is not provided with a throttle chamber and an outlet swirling chamber at the top of the cylinder. Therefore, in order to increase the tarrying time of particles in the calcining furnace, the height of the furnace and/or the inner diameter thereof must be increased. As a result, there arise various problems such as the increase in initial cost.

When the exhaust gases from one calcining furnace are distributed into a plurality of suspension preheater systems, it is preferable to provide a cyclone separator for each preheater system. The exhaust gases having the calcined particles entrained therein are generally swirling when discharged from the furnace so that the calcined particles are, by virtue of their inertia, more concentrated along the outside wall section of the outlet duct which corresponds to the radially outward portion of the vortex than along the wall section corresponding to the radially inward portion of the vortex. As a result, when the exhaust gases are distributed into a plurality of cyclone separators, the calcined particles are varied in concentration from one cyclone separator to another and consequently the operations of the suspension preheater systems including the cyclone separators are not balanced.

SUMMARY OF THE INVENTION

The present invention was made to overcome the above and other problems encountered in the prior art apparatus for calcining raw materials in the form of powder or particles. A calcining furnace in accordance with the present invention comprises a lower inverted frustoconical section, a cylinder and an upper throttle chamber including an outlet swirling chamber in the order named from the bottom to the top of the furnace. Therefore, the gas flow pattern in the furnace becomes a vortex with the gas spiraling upward. As the gases enter and spiral upward in the throttle chamber, the tangential component of their velocity is increased gradually and becomes faster than that of the particles carried by the gas. As a result, coarse particles which have not been completely calcined are separated from the swirling gases in the throttle chamber and returned to the cylinder so as to be calcined again. To put in another way, the tarrying time of the particles in the furnace can be increased. Consequently, their calcination can be much facilitated.

According to another aspect of the present invention, an outlet duct which connects the outlet of the calcining furnace to the cyclone separators includes a damper and a 180° bend section so that the nonuniform distribution of particles carried in the gases flowing through the duct can be corrected and subsequently the calcined particles can be uniformly distributed to the cyclone separators.

The present invention will become more apparent from the following description of a preferred embodiment thereof taken in conjunction with the accompanying drawings.

DETAILED DESCRIPTION OF THE PREFERRED EMBODIMENT

Figure 1:
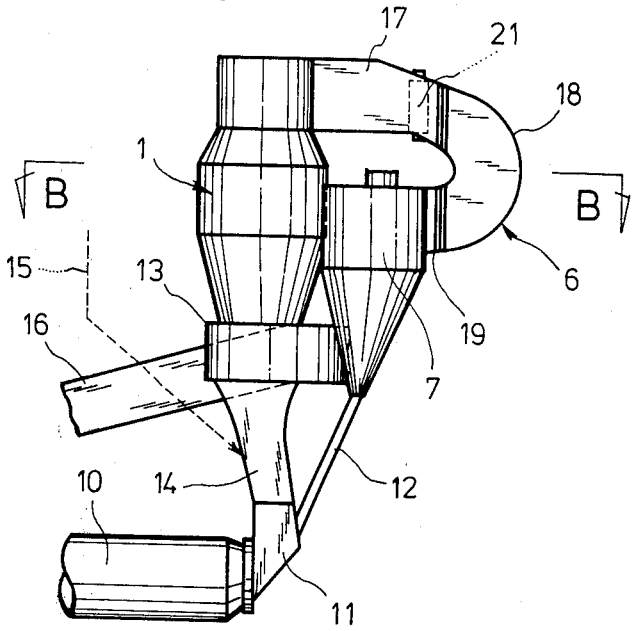
FIG. 1 is a front view of a calcination apparatus in accordance with the present invention.

Referring to FIGS. 1–5, a calcining furnace generally designated by the reference number 1 and used for calcining raw materials in the form of particles for production of, for instance, cement has a lower inverted frustoconical section 2, a cylinder 3 which has an inner diameter equal to that at the upper end of the lower section 2 and an upper throttle chamber 4 with an outlet swirling chamber 5 which is communicated through an outlet duct 6 and branched ducts 19 and 20 (See FIG. 5) with cyclone separators 7 and 8. In the lower inverted frustoconical section 2, the gases are caused to spiral not only upwardly but also radially outwardly and in the cylinder 3, the pattern of gas flow is vortex. In the upper throttle chamber 4 with the outlet swirling chamber 5 which is substantially closed, the gases are forced to flow radially inwardly as they spiral upwardly and then are forced to swirl and flow into the outlet duct 6 which is tangential to the outlet swirling chamber 5.

As best shown in FIG. 1, the inlets to the cyclone separators 7 and 8 are located lower than the outlet from the calcining furnace 1 or its outlet head 5. The exhaust gases having calcined particles entrained therein are introduced into the cyclone separators 7 and 8 where the calcined particles are separated from the exhaust gases.

Burners 9 extend through the wall of the inverted frustoconical section 2. A rotary kiln 10 has an inlet chamber 11 which is communicated through an exhaust gas duct 14 with a swirling chamber 13 communicated with the lower inverted frustoconical section 2. The swirling chamber 13 is also communicated through a combustion air duct 16 with a clinker cooler (not shown). The feed particles are charged through a feed chute 15 into the exhaust gas duct 14 so that they are entrained by the exhaust gases from the rotary kiln 10 into the calcining furnace 1 through the swirling chamber 13.

The bottoms of the cyclone separators 7 and 8 are communicated through chutes 12 with the inlet chamber 11 of the rotary kiln 10.

Figure 4:
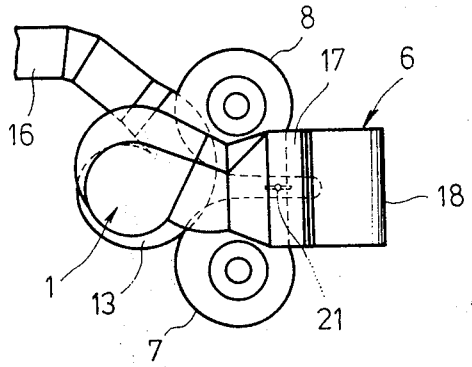
FIG. 4 is a top view of the apparatus shown in FIG. 1, a rotary kiln being omitted.
Figure 5:
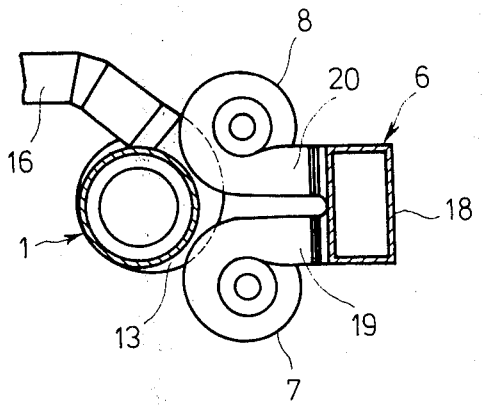
FIG. 5 is a sectional view taken along the line B—B of FIG. 1.

As best shown in FIGS. 1, 4 and 5, the outlet duct 6 comprises a horizontal section 17 one end of which is connected to the outlet of the swirling chamber 5, and a bend section 18 which bends by approximately 180° in a vertical plane. The bend section 18 is joined at its upper end to the outer end of the horizontal section 17 and is connected at its lower end to the cyclone separators 7 and 8 through the branched ducts 19 and 20 (See FIG. 5). A damper 21 is disposed in the horizontal section 17 and is used to attain the fine adjustment of the flow rate of the discharged gases.

In this embodiment, two cyclone separators 7 and 8 are shown, but it is to be understood that the number of cyclone separators can be increased or decreased as needs demand.

Next the mode of operation of the calcining apparatus with the above described construction will be described. The raw materials in the form of particles for production of, for instance, cement are preheated in a suspension system or the like (not shown) and are charged through the feed chute 15 into the duct 14. They are entrained in the exhaust gases from the rotary kiln 10 and are charged into the calcining furnace 1 in the manner described previously. The calcined particles are discharged through the outlet duct 6 and distributed through the branched ducts 19 and 20 into the cyclone separators 7 and 8. The particles separated from the exhaust gases in the cyclone separators 7 and 8 are fed through the chutes 12 and the inlet chamber 11 into the rotary kiln 10, whereby clinker is produced.

Figure 2:
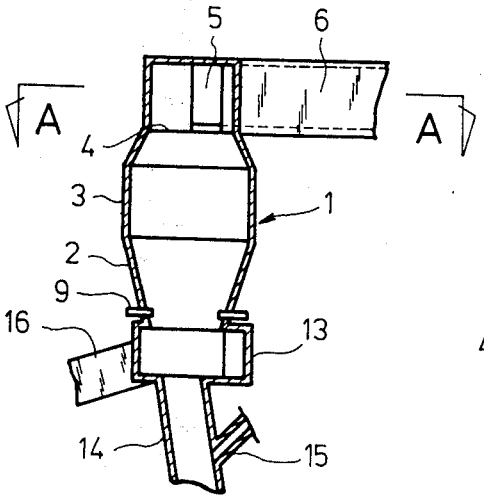
FIG. 2 is a vertical sectional view of a calcining furnace thereof.
Figure 3:
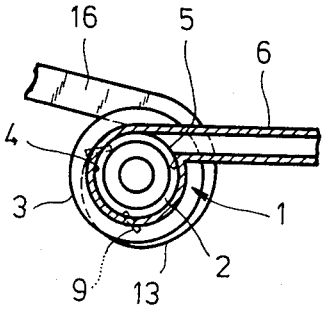
FIG. 3 is a sectional view taken along the line A—A of FIG. 2.

According to the present invention, the calcining furnace 1, which is best shown in FIG. 2, is used. The secondary combustion air is charged through the air duct 16 into the swirling chamber 13 in which the air is swirled. The swirling air is introduced into the lower inverted frustoconical section 2 and mixed with the fuel injected through the burners 9.

The raw materials which have been heated by the suspension preheater or the like are charged through the feed chute 15 into the duct 14 and are carried into the swirling chamber 13 and then into the lower inverted frustoconical section 2 by the exhaust gases discharged from the rotary kiln 10.

The particles entrained in the gases or products of combustion spiral upwardly in the lower inverted frustoconical section 2 and are partially calcined. While spiraling upward, the particles are almost completely calcined in the cylinder 3. In the upper throttle chamber 4 the gases are forced to flow radially inwardly as they spiral upward. As a result, the spiral velocity increases with decrease in diameter of the upper throttle chamber 4. However, the spiral velocity of the calcined particles is slower than that of the gases. As a result, the relatively coarse particles which have not been completely calcined yet are separated from the gas flow and impinge against the upwardly converging wall of the upper throttle chamber 4 and walls of the outlet swirling chamber 5 so that they are forced to return into the cylinder 3. They are calcined again and carried again by the upwardly spiraling gases into the throttle chamber 4. This process is repeated many times and the completely calcined particles are carried by the exhaust gases and discharged through the outlet duct 6 and the branched ducts 19 and 20 into the cyclone separators 7 and 8.

Next the outlet duct 6 which connects the calcining furnace 1 with the cyclone separators 7 and 8 will be described in more detail. The gases which entrain the calcined particles are swirling in the outlet swirling chamber 5 and flow into the horizontal section 17. Therefore when the gases flow through the section 17, the concentration of calcined particles is higher along the wall section tangent to the outlet head 5 than along the wall section not tangential thereto (See FIG. 3). This nonuniform distribution of calcined particles in the gases flowing through the horizontal section 17 is corrected to some extent by using the damper 21. In the bend section 18, the gases and hence the calcined particles carried thereby are forced to change the direction of their flow through approximately 180° in a vertical plane so that the distribution of calcined particles becomes almost uniform in the direction perpendicular to the flow of gases. As a result, the calcined particles are uniformly distributed through the branched ducts 19 and 20 into the cyclone separators 7 and 8. As a consequence, the gases are discharged from the cyclone separators 7 and 8 under almost same conditions so that the operations of the preheater systems connected to the cyclone separators 7 and 8 can be balanced.

Because of the use of the 180° bend section 18, the inlets to the cyclone separators 7 and 8 can be positioned lower than the outlet of the calcining furnace 1 by a height equal to the vertical length of the bend section 18. Therefore, the structures for supporting the cyclone separators 7 and 8 can be reduced in height so that the calcination apparatus can be made small in size.

In the bend section 18, the exhaust gases and hence the calcined particles entrained therein are forced to change their direction by approximately 180° so that there results the difference in velocity between the exhaust gases and the calcined particles and consequently the calcination of particles can be further enhanced. Thus the bend section 18 serves as a calcining furnace so that the overall calcination ratio can be considerably improved.

In this embodiment, the preheated particles are described as being fed into the duct 14 which directs the exhaust gases from the rotary kiln 10 into the calcining furnace 1, but it is to be understood that they may be charged into the lower inverted frustoconical section 2 or through the top of the throttle chamber 4. The outlet duct 6 has been described as being connected tangentially to the outlet swirling chamber 5 of the throttle chamber 4, but it is to be understood that a vortex-shaped outlet duct may be connected to the outlet swirling chamber 5.

The effects, features and advantages of the present invention may be a summarized as follows:

(i) The calcining furnace comprises the lower inverted frustoconical section, the cylinder and the upper throttle chamber 4. Therefore, the particles are calcined to some extent while they are forced to swirl in the lower section. In the cylinder they are almost completely calcined while they spiral upwardly and in the succeeding upper throttle chamber the difference in vortex velocity between the exhaust gases and particles occurs so that the coarse particles which have not been completely calcined yet are forced to return into the cylinder for recalcination as described above. Thus the calcination efficiency can be improved.

(ii) The upper throttle chamber is substantially closed. The coarse particles which have not been completely calcined are forced to return to the cylinder. As a result, only the completely and uniformly calcined particles are discharged from the outlet swirling chamber into the outlet duct. Therefore the rotary kiln can produce high quality clinker.

(iii) The tarrying time; that is, the time interval during which the particles remain in the calcining furnace is long so that they can be satisfactorily calcined. In addition, even when a fuel is used which burns for a long time, the calcining furnace can be made small in size and consequently the initial or installation cost can be reduced. Furthermore, fuel savings can be attained.

(iv) The calcined particles discharged from one calcining furnace are distributed into cyclone separators through the 180° bend section so that the concentration or distribution of particles in the direction perpendicular to the gas flow is substantially uniform after the reversal of the flow direction. In other words, the calcined particles are uniformly distributed in the exhaust gases which flow into the cyclone separators.

(v) Because of the use of the 180° bend section, the calcination apparatus can be made compact in size and the calcination efficiency can be considerably improved.

(vi) The damper for the fine adjustment of the gas flow is disposed in the horizontal section of the outlet duct preceding the bend section so that the nonuniform distribution of calcined particles in the exhaust gases can be corrected to some extent before they flow into the 180° bend section.

What is claimed is:

1. A calcining furnace for producing a vortex of upwardly spiraling gases with entrained particulate matter, comprising:

(a). lower, central and upper sections which are connected and open to each other and have a common vertical axis, (b). means at the lower part of the furnace for forming an upwardly and radially outwardly moving spiral of of gases and particulate matter, comprising i. the lower section being of inverted frusto-conical shape, ii. a chamber connected to the lower end of the lower section and shaped to impart a swirling motion to gases introduced into it, iii. means for introducing into the swirling chamber gases and entrained particulate matter, (c). means for forming an upwardly moving vortex from gases and entrained particulate matter moving upwardly from the lower section, comprising:

i. the central section being of cylindrical shape and having the same internal diameter as the upper end of the lower section, (d). means at the upper end of the furnace for increasing the velocity of the swirling gases rising from the central section and forcing them radially inwardly, comprising:

i. the upper section being frusto-conical in shape, and (e). a chamber above and open to the upper section which is so formed that gases and entrained particulate matter which enter from the upper section are giving a swirling motion, and (f). an outlet duct leading from the swirling chamber at the top of the upper section.

2. A calcining furnace according to claim 1, in which the outlet duct comprises:

(a). a first horizontal section one end of which is connected to the swirling chamber which is connected to the upper section of the furnace, (b). a second horizontal section below and parallel to the first horizontal section, and (c). a section connecting the first and second horizontal sections which bends through 180°.

3. A calcining furnace according to claim 1, comprising in addition means within the outlet duct for correcting nonuniform distribution of particulate matter entrained in the gases flowing in the duct.

4. A calcining furnace according to claim 3, in which the means are a damper pivoted about a vertical axis located in the upper horizontal section of the outlet duct.

5. A calcining furnace for producing a vortex of upwardly spiraling gases with entrained particulate matter, comprising (a). a chamber connected to the lower part of the furnace to impart a swirling motion to gases introduced into it, (b). means for introducing into the swirling chamber gases and entrained particulate matter, (c). a lower furnace section of inverted frusto-conical shape connected to receive gases and entrained particulate matter from the swirling chamber and to produce from them an upwardly and radially outwardly moving spiral of gases, (d). burners extending into the lower section, (e). a central section of cylindrical shape positioned above the lower section and having an inner diameter equal to that of the upper end of the lower section, for forming from gases and particular matter received from the lower section an upwardly moving vortex, (f). an upper section connected to the upper end of the central section and being of frusto-conical shape thereby to radially restrict the swirling flow of gases rising from the central section, (g). a chamber above and open to the upper section shaped to produce a swirling motion in gases and entrained particulate matter received from the upper section, and (h). an outlet duct leading from the upper swirling chamber of the furnace to a cyclone separator.

* * * * *